United States Patent [19]

Bondestam

[11] Patent Number: 4,813,637

[45] Date of Patent: Mar. 21, 1989

[54] KITE

[76] Inventor: Mårten Bondestam, Fabriksgatan 4, SF-00140 Helsingfors 14, Finland

[21] Appl. No.: 473,631

[22] Filed: Mar. 9, 1983

[30] Foreign Application Priority Data

Mar. 10, 1982 [FI] Finland ..... 820813

[51] Int. Cl.[4] ..... B64C 31/06

[52] U.S. Cl. ..... 244/153 R

[58] Field of Search ..... 244/153 R, DIG. 2, 142, 244/145; 46/77, 79, 74 R; D21/88

[56] References Cited

U.S. PATENT DOCUMENTS

| | | | |
|---|---|---|---|
| 2,804,276 | 8/1957 | Hutson | 244/153 R |
| 2,941,765 | 6/1960 | Feldman | 244/153 R |
| 3,524,613 | 8/1970 | Reuter et al. | 244/142 |
| 3,740,008 | 6/1973 | Gravel | 244/153 R |
| 3,806,071 | 4/1974 | Brown | 244/153 R |
| 3,822,844 | 7/1974 | Sutton | 244/145 |
| 4,129,272 | 12/1978 | Jones et al. | 244/153 R |

FOREIGN PATENT DOCUMENTS

| | | | |
|---|---|---|---|
| 1593849 | 7/1981 | United Kingdom | 244/153 R |

*Primary Examiner*—Joseph F. Peters, Jr.
*Assistant Examiner*—Rodney Corl
*Attorney, Agent, or Firm*—Cushman, Darby & Cushman

[57] ABSTRACT

A kite comprising at least two bags into which the wind is blowing through air openings in the front end of the bags, and which are joined to each other by a horizontal seam. The shroud line is attached directly to the seam or to a keel which is attached to said longitudinal seam in the middle of the kite. The air openings are diminished by pleats or the like along the edges of the openings. The openings can be closed after the filling with air or gas in which case the kite is flying like a balloon.

3 Claims, 2 Drawing Sheets

Fig. 1.
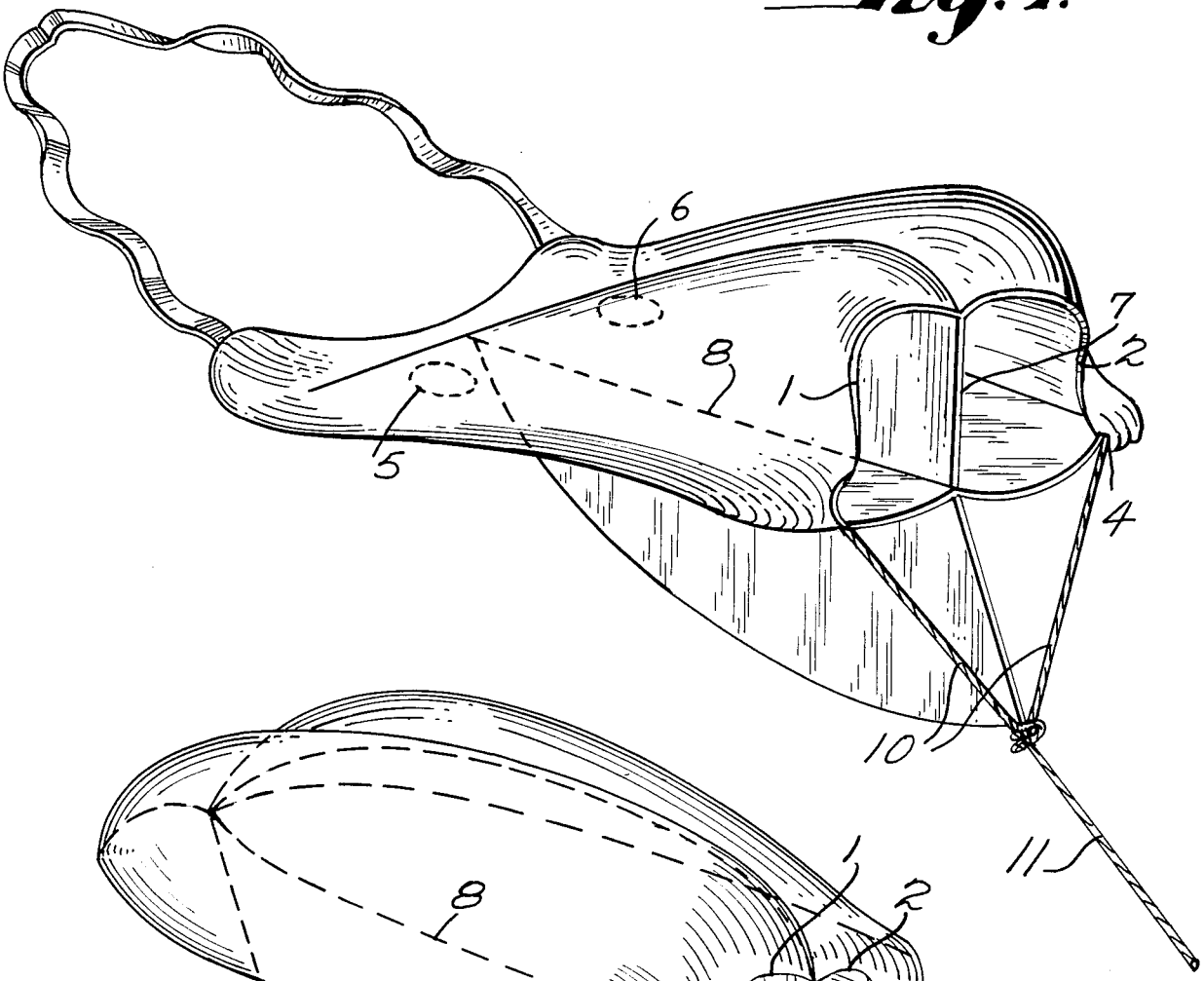
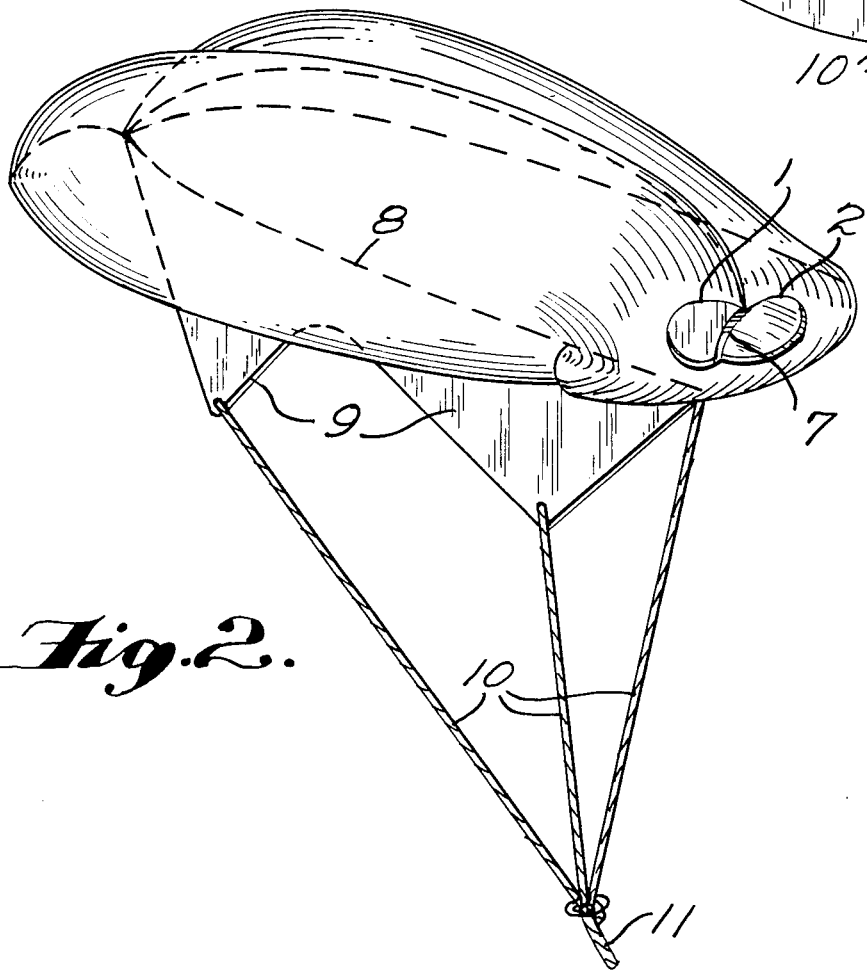
Fig. 2.

Fig. 3.
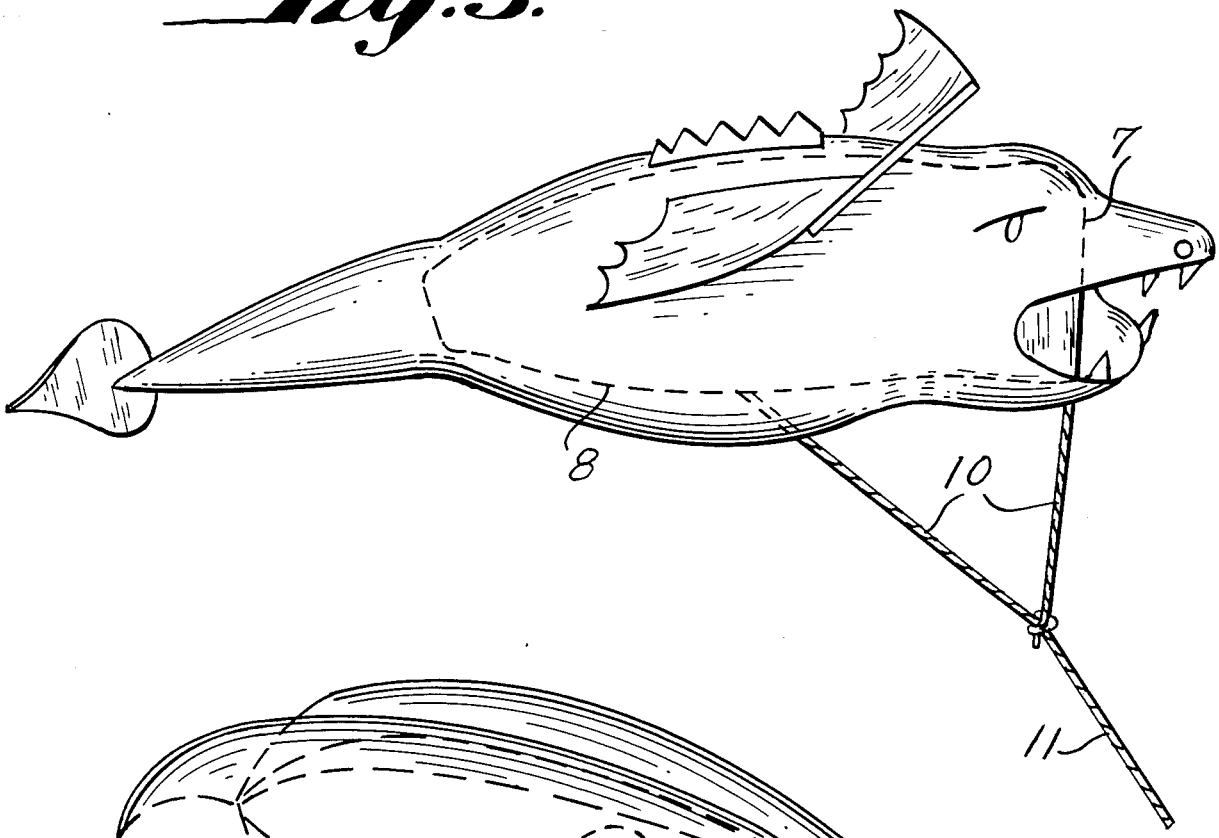
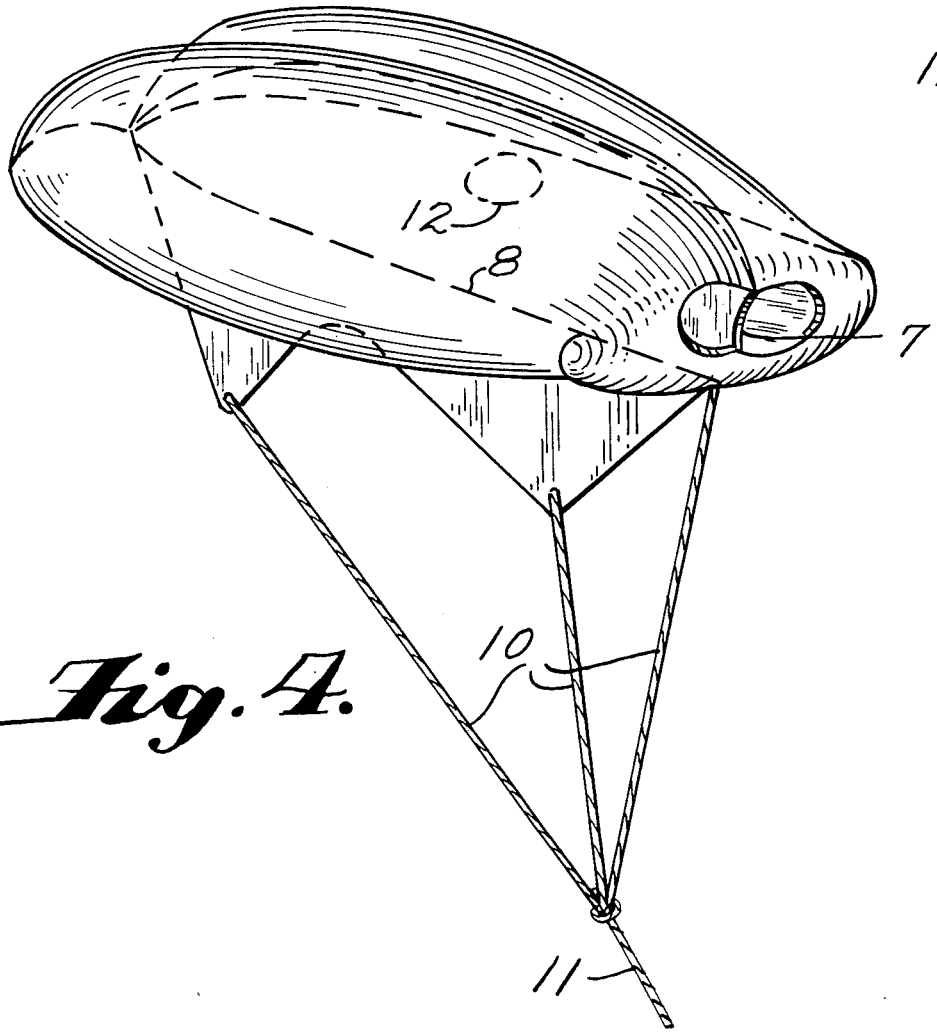
Fig. 4.

KITE

BACKGROUND OF THE INVENTION

The present invention relates to kites of the type which are filled with air by the wind. Kites of this type are prior known which consist of lateral pieces and bottom and top pieces of a fabric or a film. They may additionally have inner profiles that extend backwards from the front edge. The air can be taken in in different ways. Funnellike kites are shown on old pictures but their inner construction is unknown.

DESCRIPTION OF THE PRIOR ART

D. C. Jalbert has developed many aerial devices of multi-cell wing type. U.S. Pat. Nos. 3,285,546, Re 26,427, 3,749,337 and 3,972,495 disclose such devices. The embodiments of all these patents are based on the principal of an airfoil or wing. The wings are formed of several elongate cells adjacent each other, which cells are filled with air. The air is streaming through the cells or may be retained therein in case the ends of the canopy are folded downwardly and stitched to the bottom. There are several wedge-shaped members or keels attached to the bottom skin in the longitudinal direction and having shroud lines connected to them. The aerial device has the form of a sled wherein the flat bottom surface and the wedges encase an air space.

Edwin L. Grauel's U.S. Pat. No. 3,740,008 discloses a kite formed from two adjacent funnels having a small cross section of circular segment form and three keels depending from the outer sides and the middle of the kite. The kite is thus of the sled type.

SUMMARY OF THE INVENTION

The kite according to the invention consists of at least two bags adjacent each other, into which the wind is blowing. The bags are joined to each other with a horizontal seam. Additionally, the common front edges of the bag openings can be partly joined with each other. By the common front edge is meant that part of both bag openings that during flying is pressing against the other. The kite string is normally attached directly or via a keel to the horizontal seam. There may be many strings as well as many keels. As the inner air pressure of the kite is determined by the size of the air openings the opening is not bigger in a kite of bigger size. This leads to the fact that bigger kites must have pleats or narrowings around the air openings. On small kites the flying capability is promoted by attaching the top edge and bottom edge to each other at the left side and the right side, respectively, of the bag openings so that a front edge of a wing is formed. The top surfaces and bottom surfaces of the bags can be attached to each other in a point in the back part of each bag whereby a clumsy wing profile is formed. This wing profile has not a lifting capability caused by suction on the upper side but it gives the kite a better balance. Bigger kites do not need these arrangements but maintain instead the form of a bag.

The kite of the invention differs from prior known kites in that the right and the left element each form a circular cross-section and the bags are joined together with one horizontal seam. The kite suits very well for mass production by seam welding. Bags manufactured in mass production, preferably of plastics, can be used as starting material and are joined to each other with the one horizontal seam. The size of the bag openings are made smaller by pleats or narrowings around the bag openings. The shroud line is attached directly to the seam or to a keel which is attached to said longitudinal seam. The common front edges of the bag openings can be partly joined with each other by some means. Prior known kites are expensive and complicated to manufacture as they comprise of many elements which form almost 90° angles with each other. In flying this new kite of the invention has proved to be very strong as all forces are acting mainly in the directions of the film. In prior known kites strong tension stresses were created at the loaded right angle seams.

Small embodiments of the kite according to the invention can be used as first of May balloons. Big kites can be provided with text and act as warning signals for aeroplanes when flying with kites. Despite the clumsy, non-aerodynamic form big kites have a considerable lifting ability.

Prior known kites are provided with keels extending along the side edges. The kite of the invention has no such keel and obtains its balance on different grounds. The bags are inclined a little upwardly when seen from ahead and this gives the same balance ground as by aeroplanes having wings which are inclined a little upward toward the sides of the aeroplane body. Kites having lateral keels have a plane bottom surface which gives them a balance like the one of sled kites.

BRIEF DESCRIPTION OF THE DRAWINGS

FIG. 1 discloses a small kite in a perspective view, having the common edges 1 and 2 of the openings attached to each other, FIG. 2 discloses a big kite having the edges of the air openings shortened, FIG. 3 discloses a kite provided with decoration wings.

FIG. 4 illustrates a kite having a common wall between the bags.

DESCRIPTION OF THE PREFERRED EMBODIMENTS

In the drawings reference numerals 1 and 2 indicate the front edges of the bag openings or air openings. Numerals 3 and 4 of FIG. 1 indicate the points where the kite strings are attached at the outer side of the bottom front edge of the left and right bag. Numerals 5 and 6 of FIG. 1 indicate the points where the top surface and bottom surface of each bag are attached to each other at the rear end of the kite. Numeral 7 of FIG. 1 is indicating the seam by which the adjacent sides of the two bags are joined to form a common front edge between the two bag openings. The horizontal seam by which the two bags are attached to each other is indicated by numeral 8. The seam 8 may extend over the whole or over a part of the horizontal line between the two bags. The keels are indicated by numeral 9 and may be of different form. The kite of FIG. 1 has only one keel while the kite of FIG. 2 has two keels. The strings combining the kite with the main string are indicated by numeral 10 and the main string by numeral 11.

The kite of FIG. 3 is decorated to look like a dragon and is provided with wings and a rather long tail part.

The kite of the invention can also be used so that the bag openings are closed and the kite is filled with helium or warm air, whereby the kite is working like a kite in wind. It can also be filled with warm air through the bag openings.

The kite of the invention can also be used so that it is drawn from the strings by an aeroplane motor and an airscrew which are applied at the strings.

According to one embodiment of the invention the rear part of the kite is formed to a long tail without the wall between the two bags, which makes the kite look like a dragon. The kite can further be provided with wings and the front end of the kite can be formed to a head of a dragon.

In one further embodiment of the invention the wall between the two bags can constitute of a common film or fabric. Such common wall can be provided with openings as shown at 12 in FIG. 4.

In still one embodiment of the invention the wall between the two bags is shortened in its front end so that the side walls extend past the middle wall. This arrangement has the effect during flying the kites that a lateral wind increases the pressure in the leeward bag and tail part which in its turn has the effect that the tail part will be bent and subsequently steer the kite back against the wind. Thus flying will continue in constant movement.

What is claimed is:

1. A kite constructed of at least two bags each having an imperforate side wall of generally circular cross section, an imperforate rear end and an air opening free of struts in its front end, the bags being horizontally arranged in adjacent parallel relationship and having their side walls joined together by a seam common to both side walls and extending longitudinally along the bottom of the bags, said side walls being seamless except at said common seam and said side walls and the adjacent edges of the air openings being joined to each other along a generally vertical line lying in a plane common with said longitudinal seam to form a common front edge between adjacent air openings.

2. A kite as in claim 1 including at least two kite strings attached to the front end of the kite on opposite sides of said common front edge and at essentially equal distance from said common front edge.

3. A kite as in claim 1 including a keel extending longitudinally and protruding downwardly from said common seam, said keel being provided with strings at least one of which is attached to the front end of said keel.

* * * * *